United States Patent [19]

Schiefnetter et al.

[11] Patent Number: 4,595,308

[45] Date of Patent: Jun. 17, 1986

[54] WRITING INSERT WITH SEALING CAP

[75] Inventors: Harald Schiefnetter, Helmbechts; Richard Meyer, Nuremberg; Rudolf Rosbiegalle, Geroldsgrün, all of Fed. Rep. of Germany

[73] Assignee: A. W. Faber-Castell GmbH & Co., Stein bei Nuernberg, Fed. Rep. of Germany

[21] Appl. No.: 638,881

[22] Filed: Aug. 8, 1984

[30] Foreign Application Priority Data

Aug. 15, 1983 [DE] Fed. Rep. of Germany ..... 3329943

[51] Int. Cl.[4] ..... B43K 9/00; B43K 29/00

[52] U.S. Cl. ..... 401/243; 401/195; 401/242; 401/247; 401/251; 401/258

[58] Field of Search ..... 401/258, 259, 260, 195, 401/242, 243, 244, 245, 246, 247, 251, 258, 259, 260

[56] References Cited

U.S. PATENT DOCUMENTS

| | | | |
|---|---|---|---|
| 258,299 | 5/1882 | Holland | 401/260 |
| 363,526 | 5/1887 | Livermore | 401/260 |
| 734,116 | 7/1903 | Blair | 401/259 |
| 3,802,788 | 4/1974 | Danjczek | 401/258 X |
| 4,493,575 | 1/1985 | Mutschler | 401/258 X |

FOREIGN PATENT DOCUMENTS 7505779 12/1976 Fed. Rep. of Germany .

*Primary Examiner*—Steven A. Bratlie
*Attorney, Agent, or Firm*—Michael J. Striker

[57] ABSTRACT

A writing implement with a sealing element on a closing cap is mountable over a writing insert having a concentric writing tip, wherein the projecting part of the writing insert is provided with abutment faces and threads on which the closing cap is screwed.

10 Claims, 3 Drawing Figures

WRITING INSERT WITH SEALING CAP

BACKGROUND OF THE INVENTION

The present invention relates to a writing implement with a sealing element on a closing cap which is mountable on a writing insert provided with a concentric writing tip and extending outwardly of the housing.

Writing implements, particularly with pipe writing tip and a balance weight with a cleaning needle, especially for using of India ink, must be sealed especially reliably to prevent drying. It has been recognized that it is advantageous to seal not only the end of the writing pipe, but also to block the connection of compensating passage with the outer air. Because of formation of sediments in the event of the utilization of India ink as the writing medium, it is also necessary to clean the writing insert from time to time with removal of the same from the housing.

The DE-GM No. 7,505,779 discloses a writing implement with several sealing elements formed in the closing cap. A bowl-shaped insert is retained in the cap body and composed of an elastic material. It abuts both against the end side of the writing implement housing and also against the writing tip. Mounting of this cap body is performed with the aid of an inner thread engaged with an outer thread of the housing of the writing implement in which a writing insert is introduced.

This design of the cap body has, however, the disadvantage that the closing cap must correspond to the outer thread of the housing which in various embodiments has different diameters. This outer thread corresponds to the different receiving devices for the writing implement which, for example, for protractors and distance pieces for a drafter, considerably differ from one another.

During the utilization of the same writing insert it is therefore necessary to use different closing caps in correspondence with the different housings.

SUMMARY OF THE INVENTION

Accordingly, it is an object of the present invention to provide a writing implement which avoids the disadvantages of the prior art.

More particularly, it is an object of the present invention to provide a writing implement with a writing insert and a closing cap designed so that they can be used in a writing implement whose housing can be formed differently without the necessity of using different closing caps.

It is also an object of the present invention to provide a closing cap designed so that it has a simple construction and its outer dimensions are retained as small as possible which is an important advantage in the sense of cost of the implement.

In keeping with these objects and with others which will become apparent hereinafter, one feature of the present invention resides, briefly stated, in a writing implement in which a writing insert is inserted in a housing with the aid of a thread and has abutment faces and thread cooperating with an inner thread of a closing cap at its portion extending outwardly of the housing, and an end face of the housing abuts against an annular face of the closing cap.

In this construction the closing cap is screwed directly on the writing insert. The writing insert itself can be built in the different housings which, depending upon the application purpose, can correspond to available receiving members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
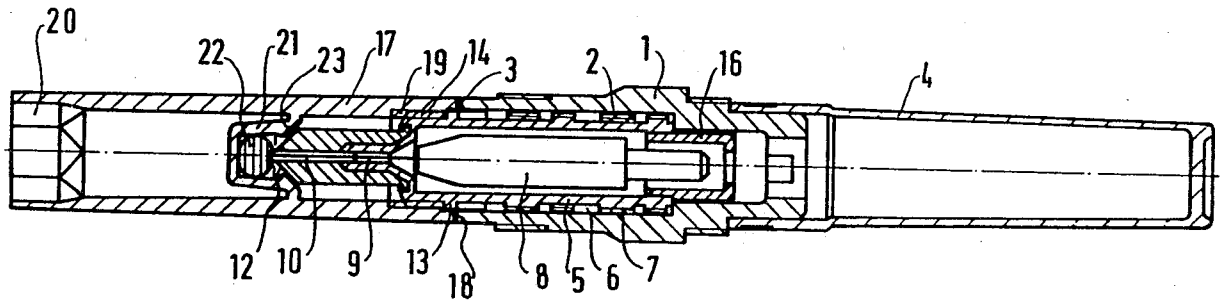
FIG. 1 is a view showing the longitudinal section of a writing implement with a sealing element, with a closing cap fitted thereon.

FIG. 1 is a longitudinal section of a writing implement in accordance with the present invention, provided with a sealing element and closing cap. The writing implement has a housing identified with reference numeral 1 and formed hollow. The housing 1 is provided in its interior with a threaded bore 2 which ends at an end face 3. A writing insert 5 is screwed in the threaded bore 2. The writing insert 5 has a thread 6 provided with helical compensating passages 7. The pitch of the compensating passages 7 declines from the thread 6.

A balance weight 8 with a cleaning wire 9 is inserted in the interior of the writing insert 5 in a known manner. The cleaning wire 9 is guided in a writing pipe 10. The latter is held for reinforcing purposes in a receiving member 11 which ends in a conical tip 12. The writing insert 5 has an annular collar 13. Threads 14 and abutment faces 15 are arranged on the annular collar 13. The balance weight 8 is held in the body of the writing insert 5 with the aid of a balance weight securing member 16. A tank for receiving a writing liquid is fitted on the housing 1.

A closing cap 17 is further provided and ends at its one side in an annular surface 18 at which an inner thread 19 is directly followed. At the opposite side, a tool for screwing the writing insert 5 is formed in the closing cap 17. The tool can be formed for example as an inner hexagon 20. A cup 21 is formed in the closing cap 13. A seal 22 composed of weak elastic material is inserted in the cup 21. The seal 22 has a sealing cone 23 which fits on the conical tip 12 of the receiving member 11.

Figures 2, 3:
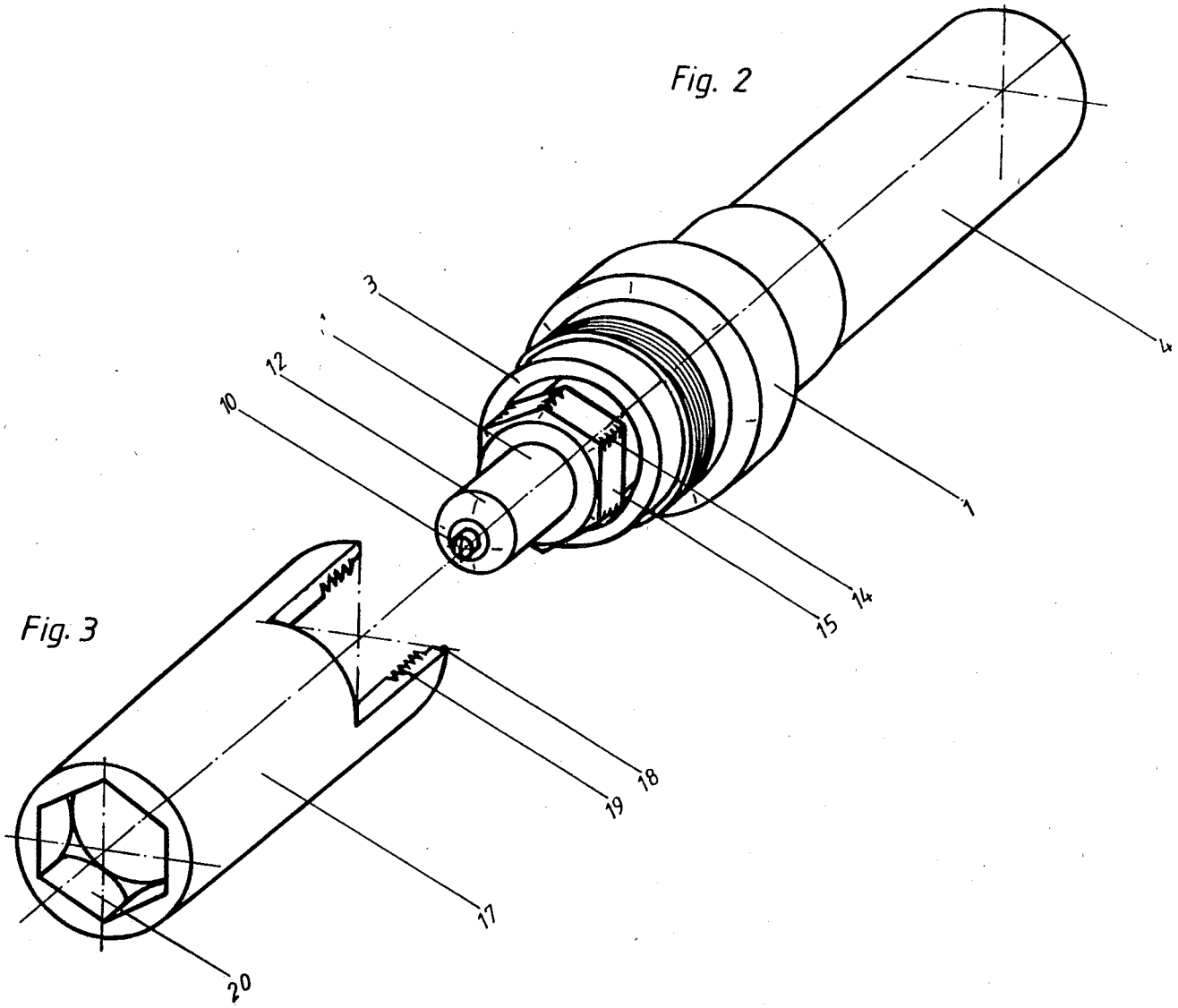
FIG. 2 is a view showing the writing implement with the writing insert in a perspective.
FIG. 3 is a perspective view of the closing cap.

FIG. 2 shows a writing implement in accordance with a preferable embodiment of the present invention, in which the abutment faces 15 on the writing insert 5 are formed as a hexagon, and the threads 14 are provided on its lateral edges. The closing cap 17 can be screwed with the aid of its inner thread 19 onto the threads 14. Sealing of the writing insert 5 is performed, on the one hand, by an abutment of the end face 3 against the annular face 18 of the closing cap 17 and, on the other hand, by penetration of the writing pipe 10 into the seal 22. In addition, the conical tip 12 abuts against the sealing cone 23 in the closing cap 17. By these features the air space which surrounds the writing pipe 10 is additionally reduced so that in the event of possibly insufficient sealing of the writing pipe 10 in the seal 22, sealing by the conical tip 12 and the sealing cone 23 will take place.

The simple construction of the writing implement with its sealing element, as shown in the drawing makes possible designing the closing cap 17 so that it must fit exclusively on the writing insert 5. The outer dimension the housing 1 is of no importance. The closing cap 17 can be retained in its dimensions very small, provides a triple sealing, and allows removal of the writing insert 5 with the aid of the unscrewing tool formed by the inner hexagonal 20 from the housing 1 in a fast manner.

It will be understood that each of the elements described above, or two or more together, may also find a useful application in other types of constructions differing from the types described above.

While the invention has been illustrated and described as embodied in a writing implement with a sealing element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A writing implement, comprising a housing having an end face; a writing insert at least partially arranged in said housing and having a concentric writing tip and a part extending outwardly of said housing; and a closing cap having an inner thread and an annular face, said writing insert having a thread with which it is inserted in said housing so as to form a pressure compensating passage therebetween, said outwardly extending part of said writing insert being provided with abutment faces for cooperating with a tool to screw said writing insert into said housing, said writing insert also having threads cooperating with said inner thread of said closing cap so that said closing cap is screwed not on said housing but on said writing insert, and said end face of said housing abutting against annular face of said closing gap.

2. A writing implement as defined in claim 1, wherein said writing insert has an annular collar, said abutment faces and said threads being provided on a periphery of said annular collar.

3. A writing implement as defined in claim 1, wherein said writing insert has an annular collar, said abutment faces and said threads being formed on said annular collar in an axially offset arrangement near one another.

4. A writing implement as defined in claim 1, wherein said writing insert has an annular collar provided with said threads, said abutment faces being formed on said annular collar by segment-shaped portions.

5. A writing implement as defined in claim 1, wherein said writing insert has an annular collar, said abutment faces being arranged on a periphery of said annular collar opposite to one another so that parts of said threads remain therebetween.

6. A writing implement as defined in claim 1, wherein said closing cap is provided directly with a cup with a seal, and also with an said inner thread fitting on said threads of said writing insert.

7. A writing implement as defined in claim 6, wherein said cup is formed with a sealing cone which fits on said writing tip.

8. A writing implement as defined in claim 1; and further comprising a container arranged to accommodate a writing medium and communicating with said writing insert, said pressure compensating passage being formed to provide air communication with said container.

9. A writing implement as defined in claim 1, wherein said threads of said writing insert are formed on said abutment faces.

10. A writing implement as defined in claim 1, wherein said abutment faces are arranged so that edges are formed therebetween on said writing insert, said threads of said writing insert being formed on said edges.

* * * * *